US008733754B2

(12) United States Patent
Mizuno

(10) Patent No.: US 8,733,754 B2
(45) Date of Patent: May 27, 2014

(54) SHEET CONVEYING DEVICE, SHEET FEED DEVICE AND IMAGE FORMING APPARATUS HAVING THE SAME

(71) Applicant: KYOCERA Document Solutions Inc., Osaka (JP)

(72) Inventor: Masahiko Mizuno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/861,199

(22) Filed: Apr. 11, 2013

(65) Prior Publication Data

US 2013/0270764 A1 Oct. 17, 2013

(30) Foreign Application Priority Data

Apr. 13, 2012 (JP) ..... 2012-091999

(51) Int. Cl.
*B65H 5/00* (2006.01)

(52) U.S. Cl.
USPC ..... 271/10.04; 271/4.04; 271/10.09; 271/10.11; 271/10.12; 271/10.13; 271/126; 271/127; 271/162

(58) Field of Classification Search
USPC ..... 271/126, 127, 162, 4.04, 10.04, 10.09, 271/10.11–10.13
See application file for complete search history.

(56) References Cited

U.S. PATENT DOCUMENTS

2003/0209849 A1* 11/2003 Lee et al. ..... 271/10.04
2005/0189698 A1 9/2005 Somemiya
2011/0198181 A1* 8/2011 Tu et al. ..... 192/20

FOREIGN PATENT DOCUMENTS

JP 2005-154076 A 6/2005

* cited by examiner

*Primary Examiner* — Prasad Gokhale
(74) *Attorney, Agent, or Firm* — Knobbe Martens Olson & Bear LLP

(57) ABSTRACT

A sheet sender 21A includes a lift plate 21P, a feed roller 21B and a registration roller 23. A biasing spring 21S applies an upward force onto the lift plate 21P. The lift plate 21P is moved upward by eccentric cams 60 which are arranged at axial ends of the feed roller 21B and rotationally driven by arm protrusions 211 which have come in contact with the eccentric cams 60. A rotational driving force is transmitted to a feed gear 220 and a registration gear 231 from a main gear 70 to rotate the feed roller 21B and the registration roller 23. A gear of the main gear 70 that engages with the feed gear 220 is idly rotatable within a predetermined angle with respect to a gear that engages with the registration roller 23.

15 Claims, 13 Drawing Sheets

(A)

(B)

SHEET CONVEYING DEVICE, SHEET FEED DEVICE AND IMAGE FORMING APPARATUS HAVING THE SAME

INCORPORATION BY REFERENCE

This application is based upon and claims the benefit of priority from the corresponding Japanese Patent Application No. 2012-091999, filed in the Japan Patent Office on Apr. 13, 2012, the entire contents of which are incorporated herein by reference.

BACKGROUND

The present disclosure relates to a sheet conveying device for conveying a sheet of recording medium, and a sheet feed device and an image forming apparatus, each of which has the same.

Sheet conveying devices for conveying a sheet of recording medium from a sheet container where a plurality of sheets of recording media are placed are preferably adopted for image forming apparatuses. Known examples of an image forming apparatus of this type include a copier, a printer, a facsimile machine, and a multi-functional peripheral having functions of these machines. In an image forming apparatus, sheets of recording media are conveyed one by one from a sheet container to an image forming unit by a sheet conveying device. Then, an image is formed on a sheet of recording medium in the image forming unit.

In order to convey sheets one by one, the sheet conveying device includes a feed roller. In addition, a lift plate is arranged in the sheet container. When an end of the lift plate moves upward, the feed roller comes in contact with a top sheet among stacked sheets. As a result, the sheet is fed out by the feed roller.

In order to continuously convey the sheets placed in the sheet container, it is necessary to maintain an end of the lift plate to be in a lifted state. A technique for implementing such a state is known, in which a position of the lift plate moved upward is maintained by an electromagnetic solenoid, for example. In addition, a technique is known which raises a lift plate by a driving unit that rotationally drives a feed roller in order to replace a driving unit dedicated to moving the lift plate such as the above-described electromagnetic solenoid. With this technique, a biasing spring arranged under the lift plate always applies an upward force to the lift plate. Cams are arranged at both ends of a rotation shaft which supports the feed roller. The cams come in contact with both ends of the lift plate to restrict the lift plate from moving upward. The cams rotate following rotation of the feed roller and an end of the lift plate moves upward, accordingly. The end of the lift plate, which is linked to the rotation of the feed roller, repeats upward and downward movement synchronously with timing of feeding a sheet.

In the above-described techniques, vibrations occur at a time of the lift plate moving upward following the collision between a sheet and the feed roller. In order to lower an adverse effect due to such vibrations on formation of an image, a lever having an elastic member is arranged between the cams and the lift plate, for example. With a swing of the lever, the elastic member eases the collision. Accordingly, the vibration transmitted to the image forming unit is reduced.

Meanwhile, in order to reduce the number of parts used in a sheet conveying device, a driving unit rotationally driving a feed roller may also serve as a driving unit of other conveyance rollers arranged downstream of the feed roller in a sheet conveying direction. Examples of such a conveyance roller include a registration roller. When the driving unit rotationally driving the feed roller rotationally drives the registration roller, an amount of rotation of cams increases at a time of the lift plate moved upward by a biasing spring. As a result, the driving unit causes the feed roller and the registration roller to experience rotational variations. In this connection, malfunctions have occurred, in which conveyance and formation of an image on a sheet is unstable, which has been antecedently conveyed and is nipped by registration rollers.

SUMMARY

In an aspect of the present disclosure, a sheet conveying device includes a lift plate onto which a sheet of recording medium is placed, a sheet conveying path, a slope part, a biasing member, a feed roller, a conveyance roller, a rotation shaft, a cam member and a gear train. The sheet conveying path is configured to convey the sheet of recording medium placed on the lift plate in a predetermined sheet conveying direction. The slope part is attached to the lift plate and configured to slope downward in the sheet conveying direction. The biasing member is configured to apply a force to the lift plate to cause a leading edge of the sheet of recording medium in the sheet conveying direction to move upward. The feed roller, which is arranged to be contactable with the leading edge of the sheet of recording medium, is configured to be rotationally driven to feed the sheet of recording medium in the sheet conveying direction. The conveyance roller, which is arranged downstream of the feed roller in the sheet conveying direction, is configured to be rotationally driven to convey the sheet of recording medium fed out by the feed roller. The rotation shaft, which extends in a sheet width direction perpendicular to the sheet conveying direction, is configured to rotatably support the feed roller. The cam member, which is arranged at the rotation shaft to be rotatable in unison with the rotation shaft, is configured to be contactable with the slope part. The driving unit is configured to generate a rotational driving force to cause the feed roller and the conveyance roller to rotate. The gear train is configured to be connected to the driving unit such that the gear train is rotationally driven. The gear train includes a first transmission part, a second transmission part and a restriction member. The first transmission part is configured to transmit the rotational driving force to one of the conveyance roller and the rotation shaft. The second transmission part, which is arranged coaxial with the first transmission part, is configured to be relatively rotatable with respect to the first transmission part and to transmit the rotational driving force to the other one of the conveyance roller and the rotation shaft. The restriction member is configured to allow a predetermined amount of relative rotation of the second transmission part with respect to the first transmission part and to subsequently restrict the relative rotation.

In another aspect of the present disclosure, a feed device is provided. The feed device includes the sheet conveying device described above and a sheet container in which a lift plate is arranged and sheets of recording media are accommodated.

In another aspect of the present disclosure, an image forming apparatus is provided. The image forming apparatus includes the sheet feed device described above and an image forming unit which forms an image onto a sheet of recording medium.

DETAILED DESCRIPTION

Figure 1:
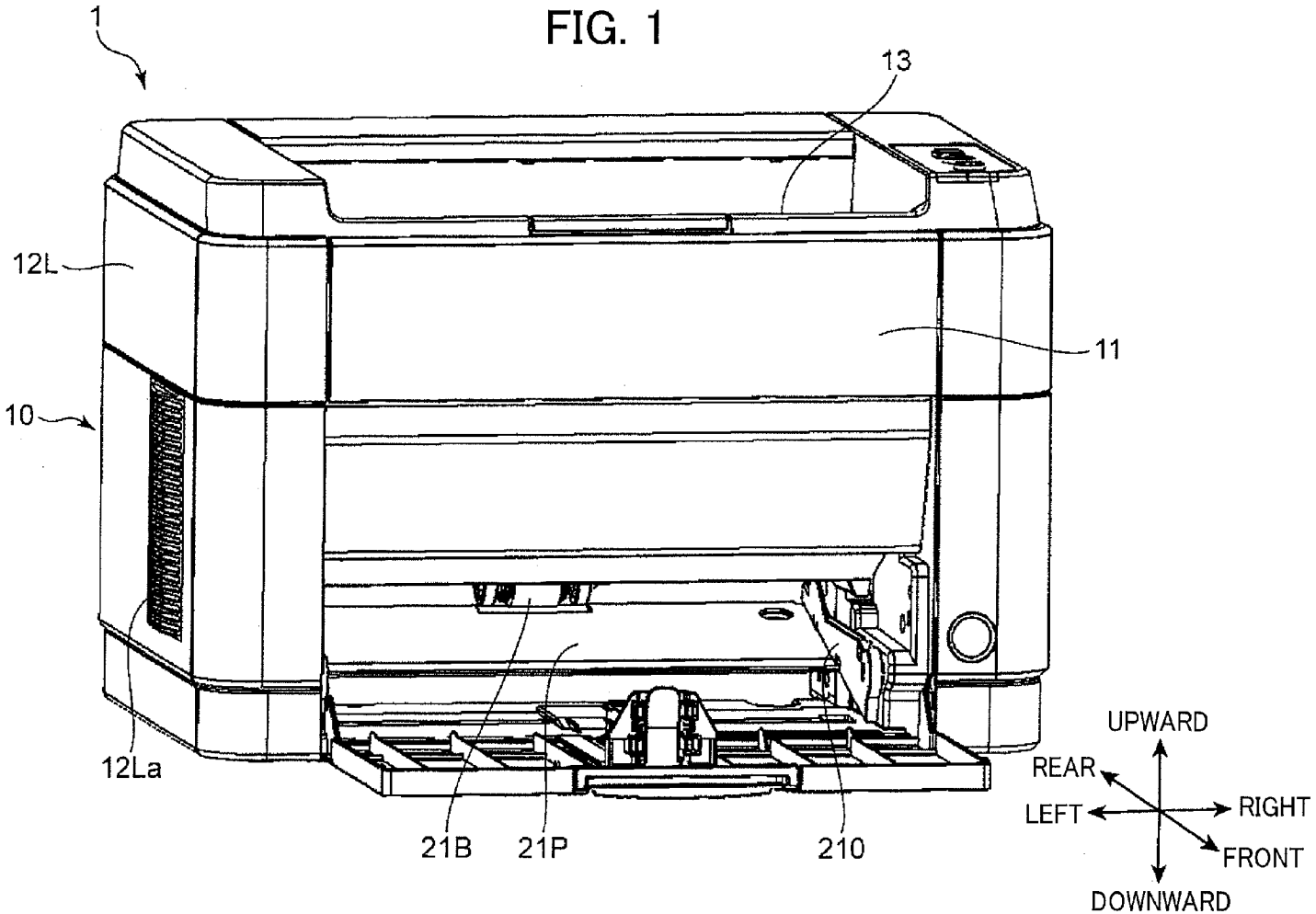
FIG. 1 is a perspective view showing an external view of an image forming apparatus 1 according to an embodiment of the present disclosure.

Hereafter, embodiments of the present disclosure will be described with reference to the drawings. Here, although a monochrome printer is exemplified as an image forming apparatus 1, the image forming apparatus 1 may be a copier, a facsimile machine, or a multi-functional peripheral having functions of these machines and may be an image forming apparatus that forms color images.

The image forming apparatus 1 includes a main housing 10 of a cabinet shaped substantially like a rectangular solid, and a feed unit 20, an image forming unit 30, a fixing unit 40 and a toner container 50, which are accommodated in the main housing 10.

A front cover 11 is provided at a front face side and a rear cover 12 is provided at a rear face side of the main housing 10. The toner container 50 is exposed when the front cover 11 is opened. Thereby, a user can take out the toner container 50 at the front face side of the main housing 10 when the toner has run out. The rear cover 12 is opened at a time of sheet jam and maintenance. When the rear cover 12 is opened, units each belonging to the image forming unit 30 and the fixing unit 40 can be removed at the rear face side of the main housing 10. In addition, a left cover 12L (FIG. 1) and a right cover 12R (not appearing in FIG. 1) opposite to the left cover 12L are arranged at side faces of the main housing 10. An inlet port 12La for introducing the air into the main housing 10 is arranged at a front portion of the left cover 12L. In addition, a paper discharge unit 13 where a sheet of recording medium after image formation is discharged is provided at a top face of the main housing 10. Various devices for performing image formation are included in an inner space encompassed by the front cover 11, the rear cover 12, the left cover 12L, the right cover 12R and the paper discharge unit 13.

Figure 2:
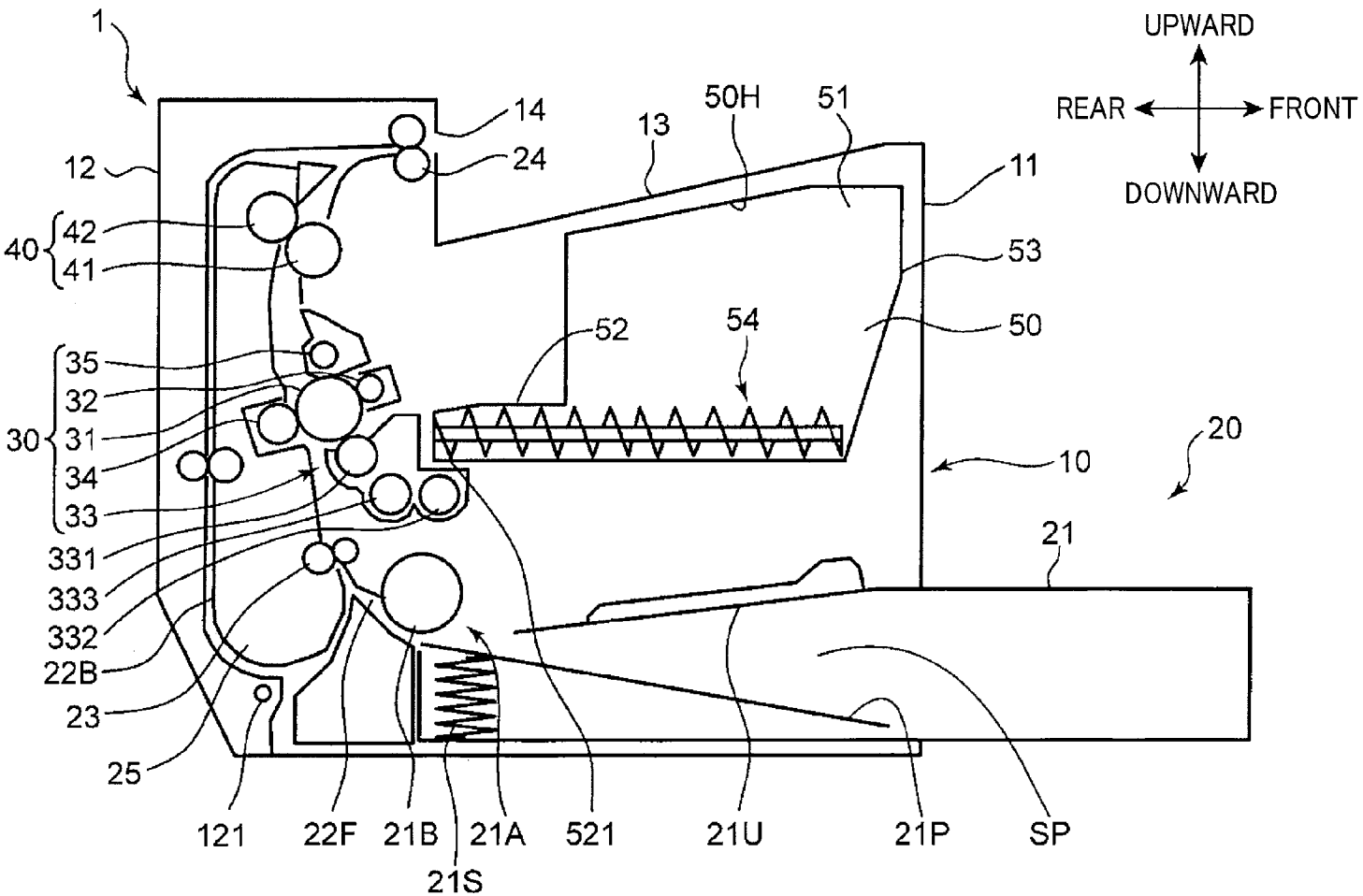
FIG. 2 is a cross-sectional view showing an internal setup of the image forming apparatus 1 according to an embodiment of the present disclosure.

The feed unit 20 (feed device) includes a feed cassette 21 which accommodates sheets P of recording media for which image formation processing is to be performed (FIG. 2). A part of the feed cassette 21 protrudes further frontward from the front face of the main housing 10. A top face of a part of the feed cassette 21 accommodated in the main housing 10 is covered with a feed cassette top plate 21U.

Provided in the feed cassette 21 are a sheet accommodation space SP for accommodating a stack of sheets P of recording media and a lift plate 21P for lifting up and feeding the stack of sheets P. A sheet sender 21A (sheet conveying device) is formed at a rear end side of the feed cassette 21. Arranged at the sheet sender 21A is a feed roller 21B for feeding out one sheet at the top layer of the stack of sheets P placed on the lift plate 21P one by one in a sheet conveying direction.

The image forming unit 30 applies processing of forming a toner image to a sheet P fed out from the feed unit 20. The image forming unit 30 includes a photosensitive drum 31 (image carrier) and devices arranged therearound including an electrification device 32, an exposure device (not appearing in FIG. 3), a developing device 33, a transfer roller 34 and a cleaning device 35.

The photosensitive drum 31 rotates clockwise and an electrostatic latent image and a toner image are formed on a circumferential surface of the photosensitive drum 31. The electrification device 32 uniformly charges the surface of the photosensitive drum 31. The cleaning device 35 performs cleaning of toner adhered onto the circumferential surface of the photosensitive drum 31 after transferring of a toner image and conveys the toner to a collector (not illustrated).

The exposure device forms an electrostatic latent image by irradiating light that is modulated based on image data given by an external device, such as a personal computer, to the circumferential surface of the photosensitive drum 31. The developing device 33 develops the electrostatic latent image on the photosensitive drum 31 to form a toner image. The developing device 33 includes a developing roller 331, a first conveying screw 332, and a second conveying screw 333. The developing roller 331 supports toner to be supplied to the photosensitive drum 31. The first conveying screw 332 and the second conveying screw 333 circulate and convey a developer while agitating it inside the developing device 33.

The transfer roller 34 transfers the toner image formed on the circumferential surface of the photosensitive drum 31 onto a sheet P. The transfer roller 34 and the photosensitive drum 31 form a transfer nip. Transfer bias having polarity opposite to the toner is given to the transfer roller 34.

The fixing unit 40 performs processing of fixing the toner image transferred onto the sheet P. The fixing unit 40 includes a fixing roller 41 and a pressing roller 42. The fixing roller 41 has a heat source inside. The pressing roller 42 comes in pressure contact with the fixing roller 41 and forms a fixing nip with the fixing roller 41. When the sheet P on which the toner image is transferred passes through the fixing nip, the toner image is fixed onto the sheet P by heating performed by the fixing roller 41 and pressing performed by the pressing roller 42.

The toner container 50 stores toner to be supplied to the developing device 33. The toner container 50 includes a container body 51, a cylindrical part 52, a cover 53 and a rotation member 54. The container body 51 is a main place where the toner is stored. The cylindrical part 52 protrudes from a lower part of one side of the container body 51. The cover 53 covers another side of the container body 51. The rotation member 54 is accommodated inside the container and conveys the toner. When the rotation member 54 rotates, the toner stored in the toner container 50 is supplied to inside the developing device 33 from a toner outlet 521 provided at an end bottom surface of the cylindrical part 52. A container top plate 50H which covers an upper portion of the toner container 50 is located under the paper discharge unit 13 (refer to FIG. 2).

A main conveying path 22F (sheet conveying path) and a reverse conveying path 22B are provided in the main housing 10 in order to convey a sheet P. The main conveying path 22F extends from the sheet sender 21A of the feed unit 20 via the image forming unit 30 and the fixing unit 40 to a discharge port 14 arranged opposite to the paper discharge unit 13 of the top face of the main housing 10. The main conveying path 22F conveys a sheet P on the lift plate 21P of the feed cassette 21 in a predetermined sheet conveying direction. The reverse conveying path 22B returns a sheet P that has undergone simplex printing back to upstream of the image forming unit 30 in the main conveying path 22F at a time of performing duplex printing.

The registration roller 23 (conveyance roller) is arranged upstream of the transfer nip between the photosensitive drum 31 and the transfer roller 34 in the main conveying path 22F. That is, the registration roller 23 is arranged downstream of the feed roller 21B in the sheet conveying direction. The registration roller 23 regulates the position of a sheet P in a sheet width direction perpendicular to the sheet conveying direction. In addition, the sheet P is stopped at the registration roller 23 to undergo skew correction. Subsequently, the sheet P is fed out to the transfer nip at predetermined timing for image transfer. A plurality of conveyance rollers for conveying a sheet P is arranged at suitable locations in the main conveying path 22F and the reverse conveying path 22B. For example, a pair of discharge rollers 24 is arranged near the discharge port 14.

The reverse conveying path 22B is formed between an outer surface of a reverse unit 25 and an inner surface of the rear cover 12 of the main housing 10. It should be noted that the transfer roller 34 and the registration roller 23 are provided at an inner surface of the reverse unit 25. The rear cover 12 and the reverse unit 25 are respectively pivotable about an axis at a fulcrum part 121 provided at lower ends of the rear cover 12 and the reverse unit 25. When a sheet jam occurs in the reverse conveying path 22B, the rear cover 12 is opened by a user for troubleshooting. When a sheet jam occurs in the main conveying path 22F, when a unit belonging to the photosensitive drum 31 is taken outside or when the developing device 33 is taken outside, the reverse unit 25 is opened in addition to the rear cover 12 by a user.

Structure of Sheet Sender 21A

Figure 3:
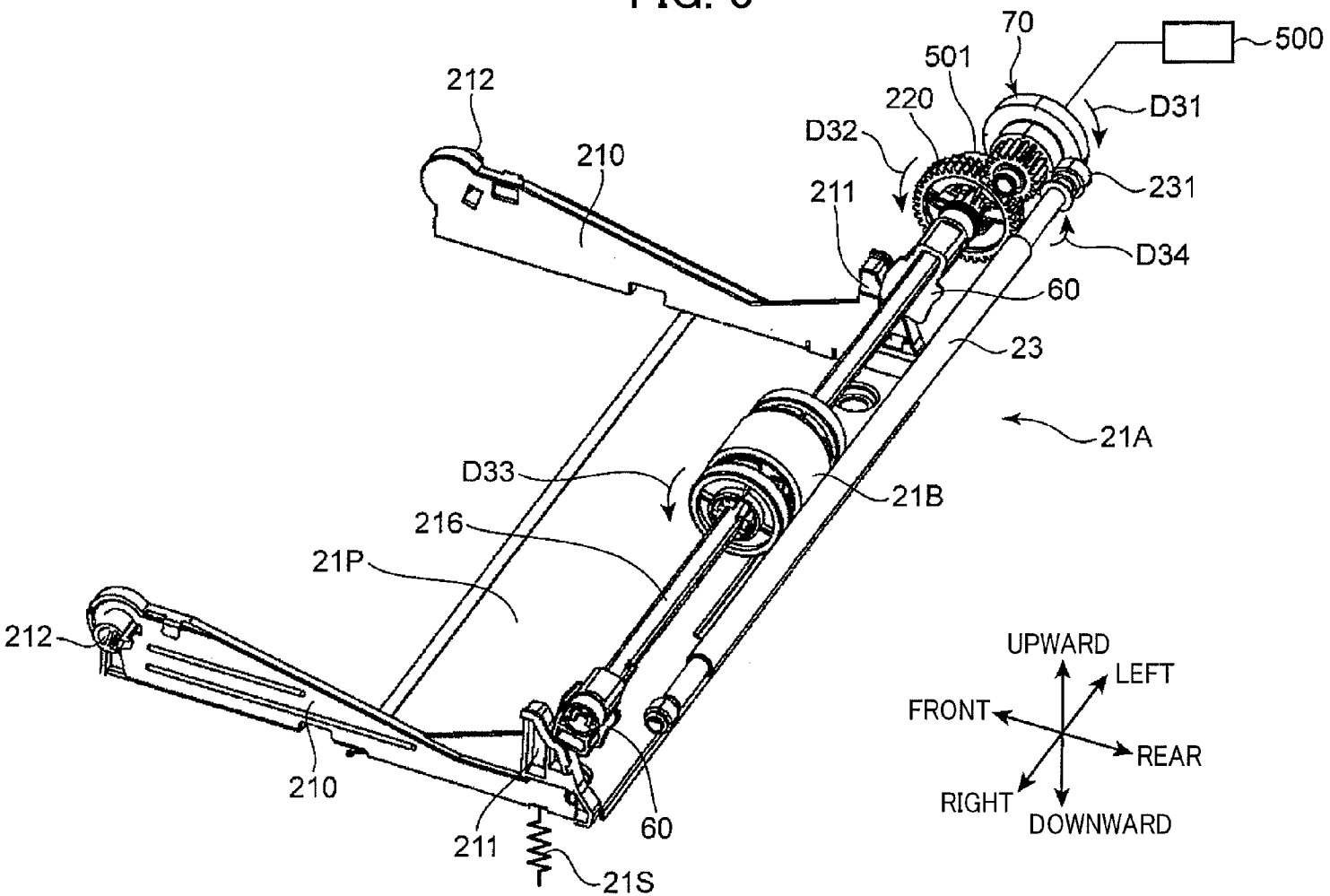
FIG. 3 is a perspective view showing a setup of a sheet conveying device according to an embodiment of the present disclosure.

Next, a setup of the sheet sender 21A (sheet conveying device) according to the present embodiment will be described with reference to FIG. 1 to FIG. 3. FIG. 3 is a perspective view showing the setup of the sheet sender 21A.

With reference to FIG. 3, the sheet sender 21A includes arms 210 (arm part), a biasing spring 21S (biasing member), a shaft 216 (rotation shaft), eccentric cams 60 (cam member), a main gear 70 (gear train), a feed gear 220 (third gear), a registration gear 231, a driving unit 500 (driving unit), and a clutch 501 in addition to the lift plate 21P, the feed roller 21B, and the registration roller 23.

The lift plate 21P is like a plate having a predetermined width in a front-rear direction and extends in a left-right direction. As shown in FIG. 1 and FIG. 2, the lift plate 21P is arranged at a rear portion of the feed cassette 21 inside the main housing 10. The lift plate 21P according to the present embodiment is made of sheet metal. A plurality of sheets P of recording media is placed on the lift plate 21P.

A pair of arms 210 is arranged at both ends of the lift plate 21P in the sheet width direction (left-right direction). An arm 210 is made of a plate-like member extending in the front-rear direction. The arm 210 includes an arm protrusion 211 (arm protrusion) and an arm fulcrum part 212 (shaft support). The arm protrusion 211 is arranged at a rear end of the arm 210. The arm protrusion 211 is a protruding piece that extends upward. The arm protrusion 211 has a shape substantially like a right angled triangle having an oblique side rearward, when viewed in cross-sectional views in the front-rear direction and an upward-downward direction. Formed at the oblique side are three slopes (slope part), which include a locking slope 213 (first slope), a 21st slope 214 (second slope) and a 22nd slope 215 (third slope). These three slopes are connected with each other with a gently curved surface therebetween (refer to FIG. 6). The arm fulcrum part 212 is arranged at a front end of the arm 210. The arm fulcrum part 212 is a hole having a predetermined depth in the left-right direction. A shaft (not illustrated) which is arranged in the main housing 10 is fit into the arm fulcrum part 212. The arm fulcrum part 212 pivotally supports the lift plate 21P about the shaft (not illustrated).

The biasing spring 21S is arranged between a lower surface of the lift plate 21P and a bottom of the main housing 10 (refer to FIG. 2). A pair of biasing springs 21S is arranged at a rear end and both ends in the left-right direction of the lift plate 21P. The rear portion of the lift plate 21P is biased upward by the pair of biasing springs 21S. That is, the pair of biasing springs 21S applies a force to the lift plate 21P to cause a leading edge of a sheet P of a recording medium in the conveyance direction to move upward. Simultaneously, a front portion of the lift plate 21P is supported by the arm fulcrum part 212. That is, the lift plate 21P is biased by the biasing spring 21S such that the rear portion of the lift plate 21P pivotally moves up and down about the arm fulcrum part 212, when viewed in cross-sectional views of the front-rear and upward-downward direction.

The feed roller 21B is fixed to the shaft 216 and rotates integrally with the shaft 216. The shaft 216 is arranged in the sheet width direction (left-right direction). The feed roller 21B is fixed to a substantially middle portion of the shaft 216 in the left-right direction (width direction of a sheet P).

A pair of eccentric cams 60 is arranged at both ends of the shaft 216 in the left-right direction. The eccentric cam 60 is a protruding piece that protrudes from the shaft 216 in a radial direction of the shaft 216. The eccentric cam 60 is fixed to the shaft 216 and rotates integrally with the shaft 216. The eccentric cam 60 is arranged opposite to the arm protrusion 211 of the arm 210. Since the rear end of the lift plate 21P is biased upward by the pair of biasing springs 21S, each of the pair of eccentric cams 60 comes in contact with the arm protrusion 211 of the arm 210. The eccentric cam 60 is shaped substantially like a rectangle when viewed in cross-section in the upward-downward and front-rear direction. A contact part 601 having a curved shape is arranged at an end of the eccentric cam 60 (refer to FIG. 4).

The main gear 70 is rotatably supported at a left side of the lift plate 21P by a shaft (not illustrated) arranged in the main housing 10. The main gear 70 is linked to the driving unit 500 and is rotationally driven by the driving unit 500. The main gear 70 includes a registration transmission gear 711 (first transmission part) and a feed transmission gear 721 (second transmission part) (refer to FIG. 7). The registration transmission gear 711 transmits a rotational driving force to the registration roller 23. The feed transmission gear 721, which is arranged coaxially with the registration transmission gear 711 and rotatable relative to the feed gear 220, transmits a rotational driving force to the shaft 216. Furthermore, the main gear 70 has a coil spring 73 (restriction member) (refer to FIG. 9), which will be described later. A setup of the main gear 70 will be described in detail later.

The feed gear 220 is fixed to a left end of the shaft 216. In addition, the feed gear 220 is engageable with the feed transmission gear 721 (FIG. 7) of the main gear 70. The registration gear 231 is fixed to an end of a shaft extending from the registration roller 23 to the left. The registration gear 231 engages with the registration transmission gear 711 (FIG. 7) of the main gear 70.

The driving unit 500 is a motor which generates a rotational driving force. The driving unit 500 generates the rotational driving force by which the eccentric cam 60 is moved and the feed roller 21B and the registration roller 23 are rotated. The driving unit 500 is connected to the main gear 70.

The clutch 501 is arranged at a left side of the feed gear 220. The clutch 501 switches between coupling and decoupling of transmission of a rotational driving force between the main gear 70 and the feed gear 220. The clutch 501 is configured to be stopped after the feed roller 21B is rotationally driven one revolution synchronously with timing of feeding a sheet P of a recording medium. Simultaneously, the pair of eccentric cams 60 fixed to the shaft 216 is also rotationally driven one revolution synchronously with the timing of feeding the sheet P.

Operation of Sheet Sender 21A

Figure 4:
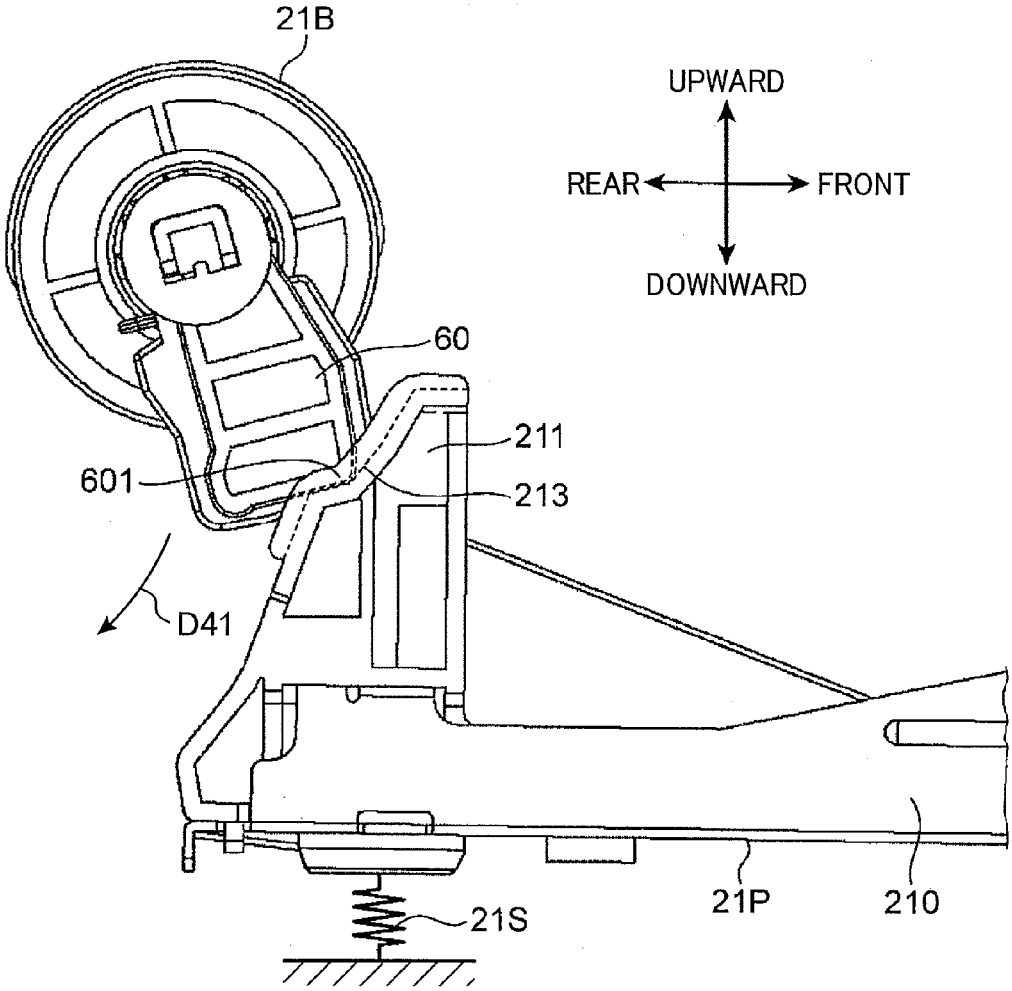
FIG. 4 is a cross-sectional view for illustrating the behavior of an eccentric cam 60 and an arm protrusion 211 according to an embodiment of the present disclosure.
Figure 5:
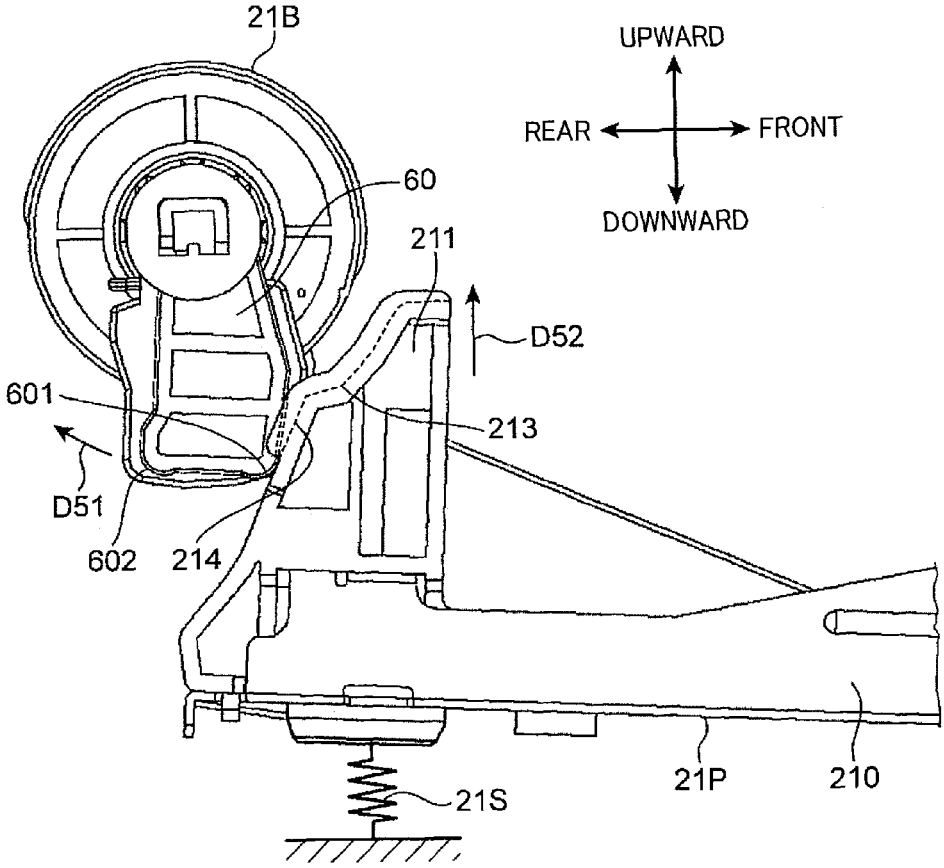
FIG. 5 is a cross-sectional view for illustrating the behavior of the eccentric cam 60 and the arm protrusion 211 according to an embodiment of the present disclosure.
Figure 6:
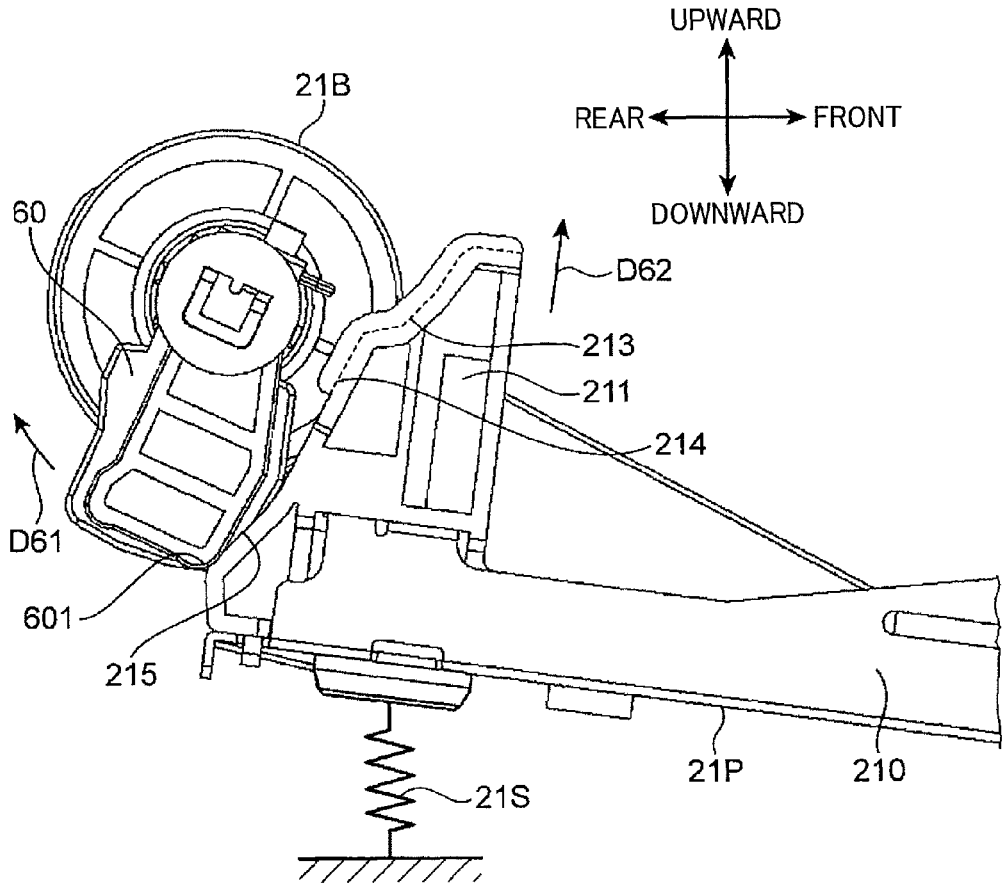
FIG. 6 is a cross-sectional view for illustrating the behavior of the eccentric cam 60 and the arm protrusion 211 according to an embodiment of the present disclosure.
Figure 7:
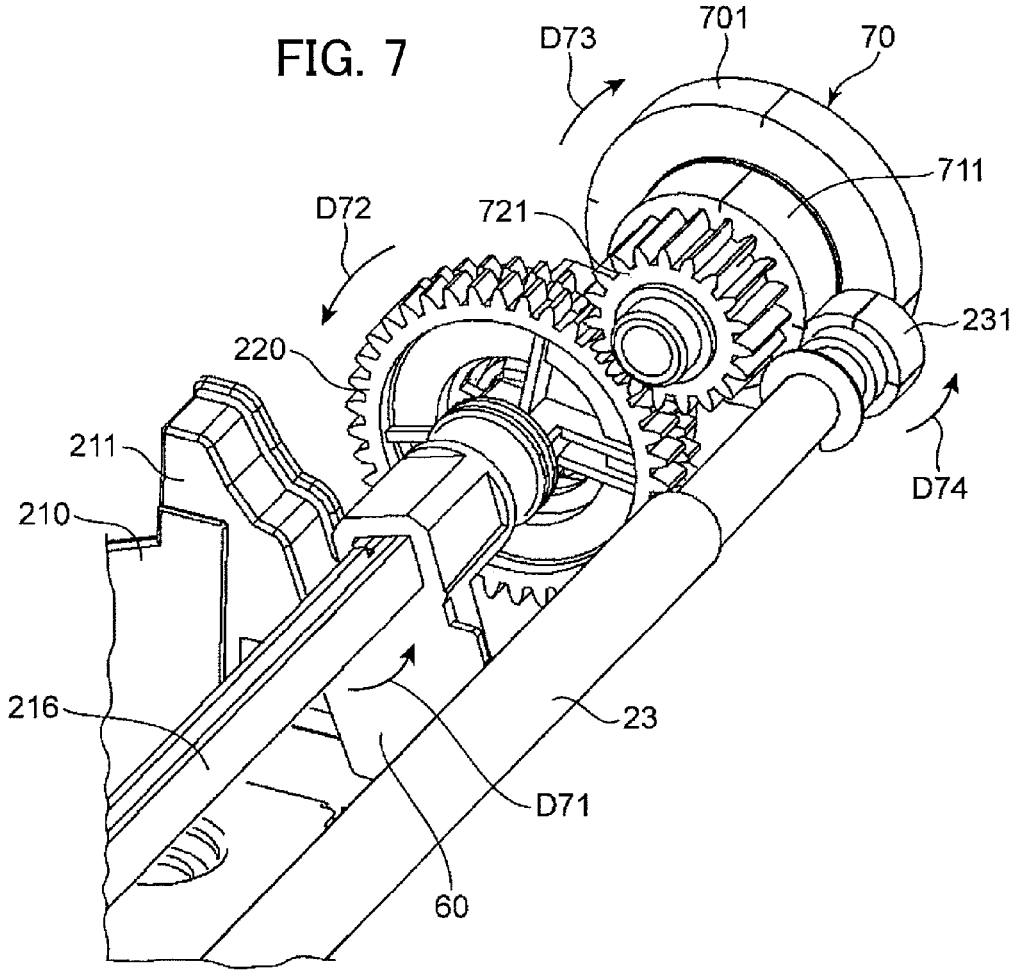
FIG. 7 is an expanded perspective view of a drive transmission unit of a sheet conveying device according to an embodiment of the present disclosure.

Next, the operation of the sheet sender 21A will be described with reference to FIG. 4 to FIG. 7. FIG. 4 to FIG. 6 are cross-sectional views for illustrating the behavior of the eccentric cam 60 and the arm protrusion 211, which constitute the sheet sender 21A. FIG. 4 shows a situation where the arm protrusion 211 is locked by the eccentric cam 60 and the lift plate 21P is arranged at the lowermost position. FIG. 5 shows a situation where the arm protrusion 211 has moved upward following the rotation of the eccentric cam 60, when sheets P of recording media of the maximum number are placed on the lift plate 21P. Similarly, FIG. 6 shows a situation where the arm protrusion 211 has moved upward following the rotation of the eccentric cam 60, when sheets P of recording media of the minimum number are placed on the lift plate 21P. FIG. 7 is an expanded perspective view of a drive transmission unit of the sheet sender 21A.

Referring now to FIG. 4, the lift plate 21P is located at the lowermost position (first position) when the image forming apparatus 1 is not performing image formation processing. At this time, the lift plate 21P is receiving an upward biasing force applied by the biasing spring 21S. However, the contact part 601 of the eccentric cam 60 is in contact with the locking slope 213 (first slope) of the arm protrusion 211. Accordingly, the biasing spring 21S experiences elastic deformation, so that the lift plate 21P is restricted from moving upward. Even if the sheets P of the maximum number are placed on the lift plate 21P, a topmost sheet of the sheets P does not come in contact with a circumferential surface of the feed roller 21B for a case where the lift plate 21P is located at the lowermost position.

Referring now to FIG. 3 and FIG. 7, a sheet P of recording medium is fed out from the feed cassette 21 (FIG. 2) following image formation processing performed by the image forming apparatus 1. The driving unit 500 drives the main gear 70 to rotate (arrow D31 in FIG. 3 and arrow D73 in FIG. 7) synchronously with timing of forming an image performed by the image forming unit 30. At this time, the clutch 501 maintains the transmission of a driving force from the main gear 70 to the feed gear 220. As the main gear 70 is rotationally driven by the driving unit 500, a rotational driving force is transmitted from the registration transmission gear 711 of the main gear 70 to the registration gear 231, thereby rotationally driving the registration roller 23 (arrow D34 in FIG. 3 and arrow D74 in FIG. 7). Similarly, a rotational driving force is transmitted from the feed transmission gear 721 of the main gear 70 to the feed gear 220 (arrow D32 in FIG. 3 and arrow D72 in FIG. 7), thereby rotationally driving the eccentric cam 60 and the feed roller 21B (arrow D33 in FIG. 3 and arrow D71 in FIG. 7).

The rotational driving force transmitted from the main gear 70 causes the eccentric cam 60 to rotate, allowing the lift plate 21P to move upward. Referring now to FIG. 4 and FIG. 5, the behavior of the eccentric cam 60 and the lift plate 21P when the sheets P of the maximum number are placed on the lift plate 21P will be described. As the eccentric cam 60 is rotationally driven, the contact part 601 in contact with the locking slope 213 moves in a direction of arrow D41 in FIG. 4. Subsequently, the contact part 601 of the eccentric cam 60 moves smoothly from the locking slope 213 (first slope) of the arm protrusion 211 to the 21st slope 214 (second slope) (FIG. 5).

As the contact part 601 moves, the arm protrusion 211 starts to move upward by the biasing force of the biasing spring 21S (arrow D52 in FIG. 5). That is, the contact part 601 of the eccentric cam 60 comes in contact with the 21st slope 214, so that the lift plate 21P approaches more the feed roller 21B (second position) than the first position. When the contact part 601 comes in contact with a lower end of the 21st slope 214, as shown in FIG. 5, the leading edge of a topmost sheet P of sheets P placed on the lift plate 21P comes in contact with the circumferential surface of the feed roller 21B. As a result, the upward movement of the lift plate 21P stops (third position). Thereafter, the eccentric cam 60 rotates further to depart away from the arm protrusion 211.

When the upward movement of the lift plate 21P comes to a stop, the feed roller 21B and the eccentric cam 60 rotate further by the rotational driving force transmitted from the main gear 70. The topmost sheet P is fed out by rotation of the feed roller 21B toward the main conveying path 22F (FIG. 2) downstream of the sheet conveying direction. Thereafter, when the eccentric cam 60 rotates substantially one revolution, an edge 602 of the eccentric cam 60 presses the arm protrusion 211 downward while being in contact with the locking slope 213 of the arm protrusion 211. As the lift plate 21P moves downward, the biasing force disappears, which causes the sheet P to come in contact with the circumferential surface of the feed roller 21B. However, as described above, the circumferential length of the feed roller 21B is set greater than the distance between the feed roller 21B and the registration roller 23 in the main conveying path 22F when viewed in a cross-section perpendicular to the shaft 216. Accordingly, the leading edge of the sheet P has already entered the nip of the registration roller 23 at a time of the downward movement performed by the lift plate 21P. In this manner, conveyance of the sheet P is continued by the registration roller 23. In a state where the feed roller 21B and the eccentric cam 60 have rotated substantially one revolution, a clutch 502 disconnects the transmission of the rotational driving force between the main gear 70 and the feed gear 220. As a result, the feed roller 21B and the eccentric cam 60 stop rotating, so that the feed roller 21B, the eccentric cam 60 and the arm protrusion 211 return to the state shown in FIG. 4.

Similarly, with reference to FIG. 4 and FIG. 6, the behavior of the eccentric cam 60 and the lift plate 21P will be described when a sheet P of a minimum number of sheets (one sheet) is placed on the lift plate 21P. When the number of sheets P placed on the lift plate 21P is small, the lift plate 21P is moved more upward than the case shown in FIG. 5 in order to cause the leading edge of the sheet P to come in contact with the circumferential surface of the feed roller 21B. That is, the contact part 601 of the eccentric cam 60 moves from the locking slope 213 of the arm protrusion 211 to the 22nd slope 215 smoothly via the 21st slope 214 (FIG. 6). Accordingly, the arm protrusion 211 moves upward as shown by arrow D62 in FIG. 6 by a biasing force applied by the biasing spring 21S. Subsequently, the leading edge of the sheet P placed on the lift plate 21P comes in contact with the circumferential surface of the feed roller 21B in a state where the contact part 601 is in contact with the lower end of the 22nd slope 215. As a result, the upward movement of the lift plate 21P stops. After the upward movement of the lift plate 21P comes to a stop, similarly to what has been described above, the sheet P is fed out toward the main conveying path 22F, and the lift plate 21P moves downward following the eccentric cam 60 rotating substantially one revolution.

In the present embodiment, as the eccentric cam 60 rotates, the biasing spring 21S biases the lift plate 21P upward, enabling the lift plate 21P to move upward. At this time, the contact part 601 of the eccentric cam 60 smoothly moves from the locking slope 213 of the arm protrusion 211, the 21st slope 214 to the 22nd slope 215. Accordingly, it is possible to prevent sudden upward movement of the lift plate 21P due to the biasing force applied by the biasing spring 21S, preventing the separation between the sheet P placed on the lift plate 21P and the circumferential surface of the feed roller 21B. As a result, it is possible to prevent a collision noise from occurring in the image forming apparatus 1.

Meanwhile, as described above, when the eccentric cam 60 is gradually released from the arm protrusion 211 as the eccentric cam 60 rotates, an image defect may arise due to the biasing force applied by the biasing spring 21S. As described above, the eccentric cam 60 is rotationally driven in the direction of arrow D71 in FIG. 7 by the rotational driving force transmitted to the feed gear 220 from the main gear 70. As shown in FIG. 6, the biasing force applied by the biasing spring 21S is transmitted to the eccentric cam 60 via the arm protrusion 211, when the lift plate 21P moves upward as the eccentric cam 60 rotates. As a result, a rotational driving force PW2 exerted by the arm protrusion 211 is applied to the eccentric cam 60 in addition to a rotational driving force PW1 transmitted from the main gear 70. It is possible that this rotational driving force PW2 may cause the eccentric cam 60 to rotate excessively. In addition, it is possible that excessive rotation of the eccentric cam 60 may result in excessive rotation of the feed gear 220 through the shaft 216. As described above, in the main gear 70 according to the present embodiment, the registration transmission gear 711 for transmitting rotational driving force to the registration roller 23 is arranged coaxial with the feed transmission gear 721 which rotationally drives the feed roller 21B. As described above, the excessive rotation occurring at the feed gear 220 is also transmitted to the registration roller 23 as a rotational variation from the registration transmission gear 711 via the registration gear 231, after the excessive rotation is transmitted to the main gear 70 via the feed transmission gear 721.

Figure 8:
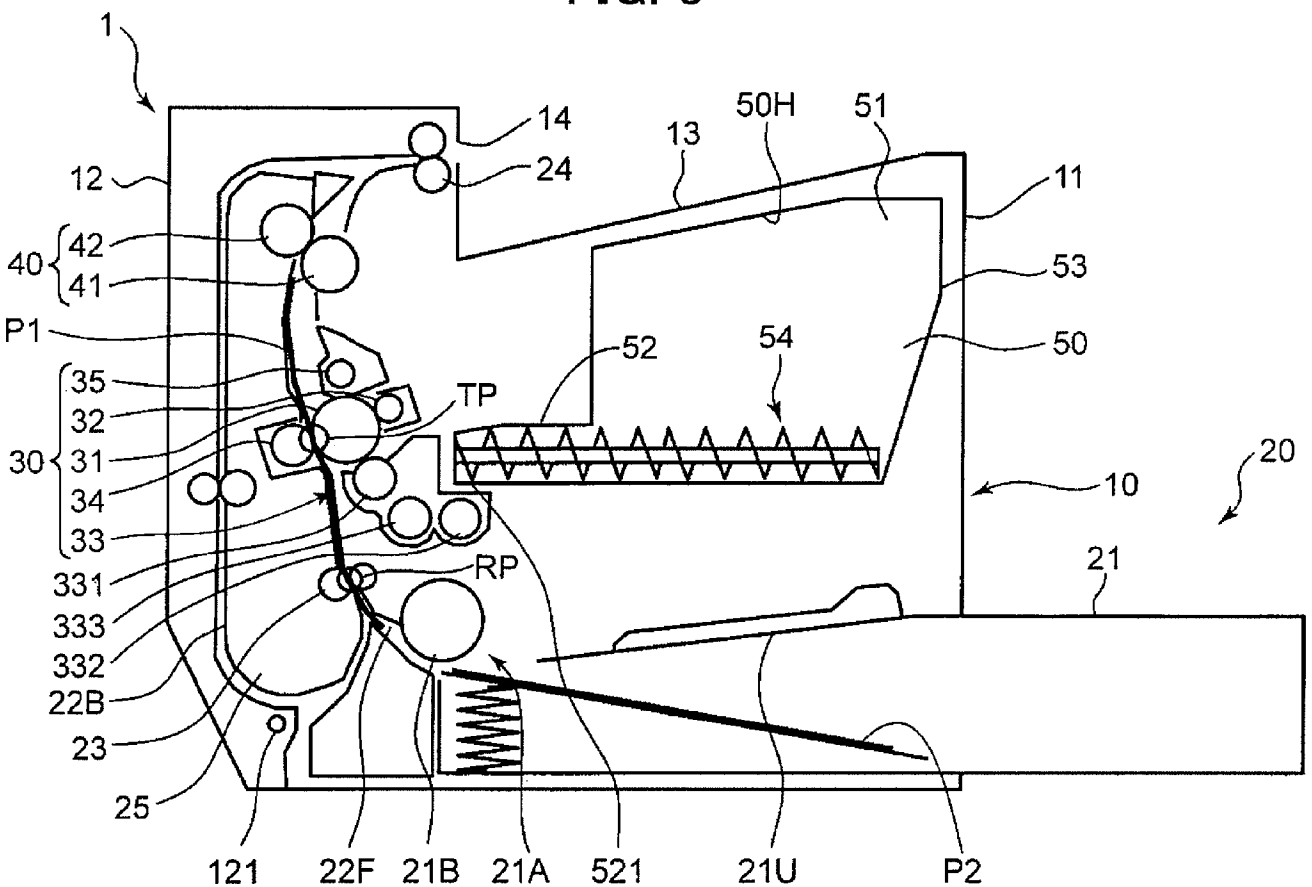
FIG. 8 is a cross-sectional view showing a situation where a sheet of paper P is conveyed inside an image forming apparatus.

FIG. 8 is a diagram illustrating a state where a plurality of sheets P of recording media is continuously conveyed in the main conveying path 22F of the image forming apparatus 1. At a transfer nip TP between the transmission roller 34 and the photosensitive drum 31, a toner image is transferred to a preceding sheet P1 of recording medium conveyed in the main conveying path 22F. At this time, a rear end of the sheet P1 is still being conveyed by the registration roller 23. Conveyance of a following sheet P2 of recording medium is started at timing by which the sheet P2 is provided with a predetermined interval with respect to the sheet P1. If the above-mentioned rotational variation (excessive rotation) is brought to the registration roller 23 from the eccentric cam 60, the sheet P1 experiences a change in its conveyance speed. As a result, it may be that misalignment occurs in the transfer of a toner image at the transfer nip TP, resulting in an image defect.

Setup of Main Gear 70

Figure 9:
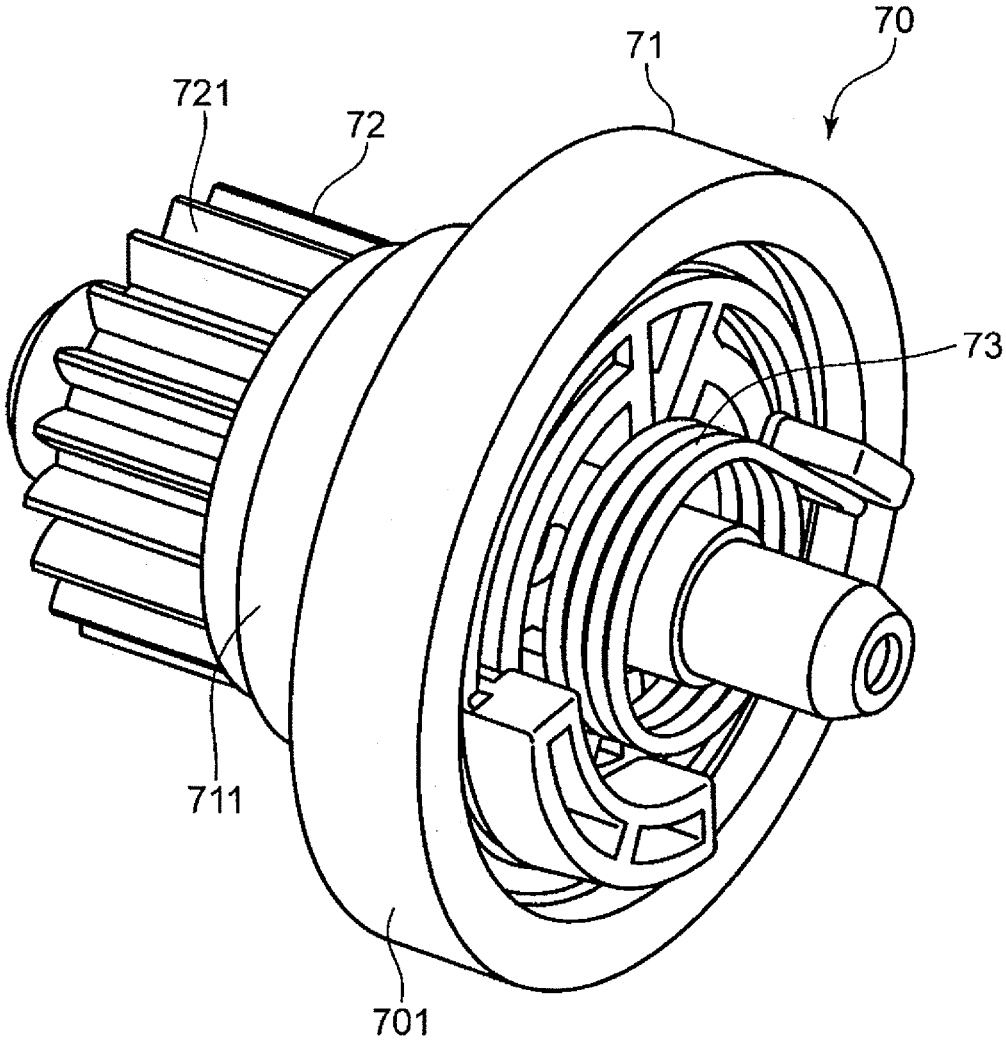
FIG. 9 is a perspective view of a main gear 70 according to an embodiment of the present disclosure.
Figure 10:
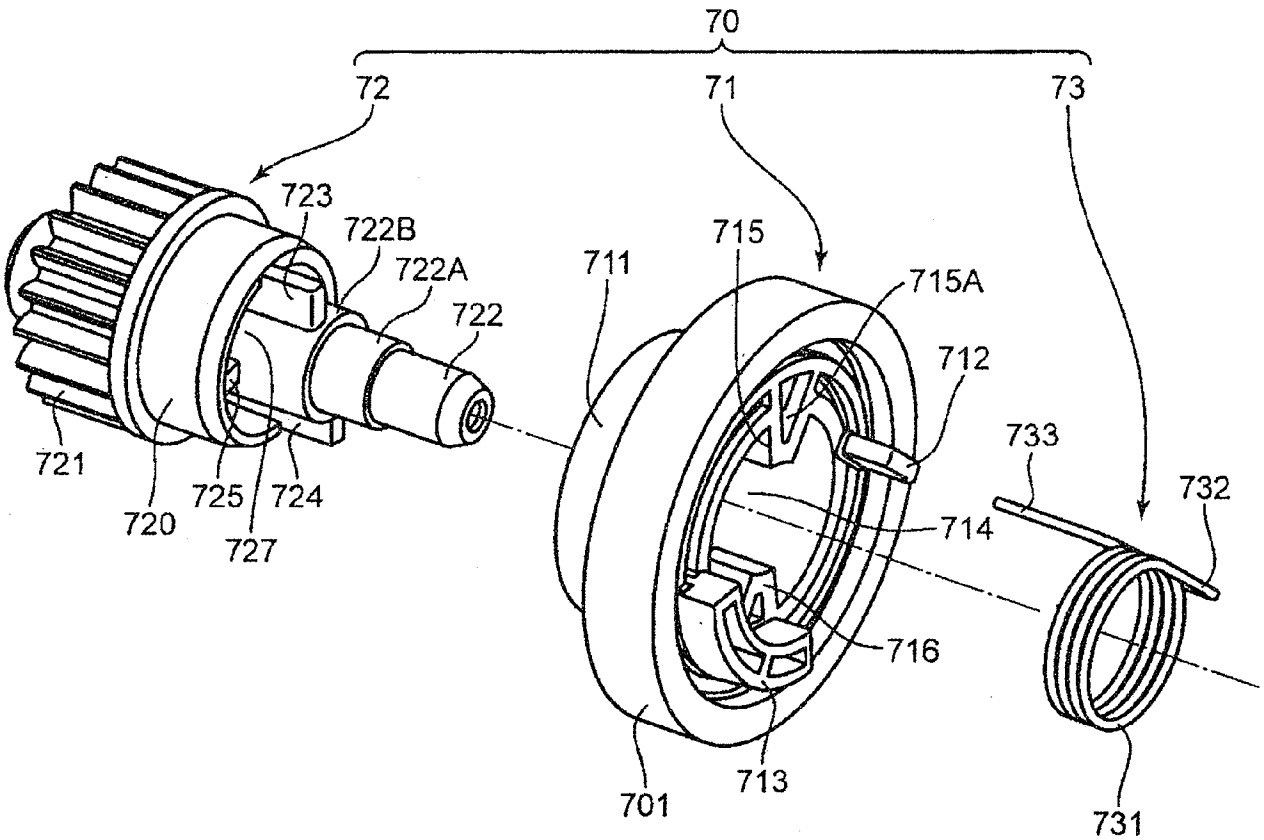
FIG. 10 is an exploded perspective view of the main gear 70.
Figure 11B:
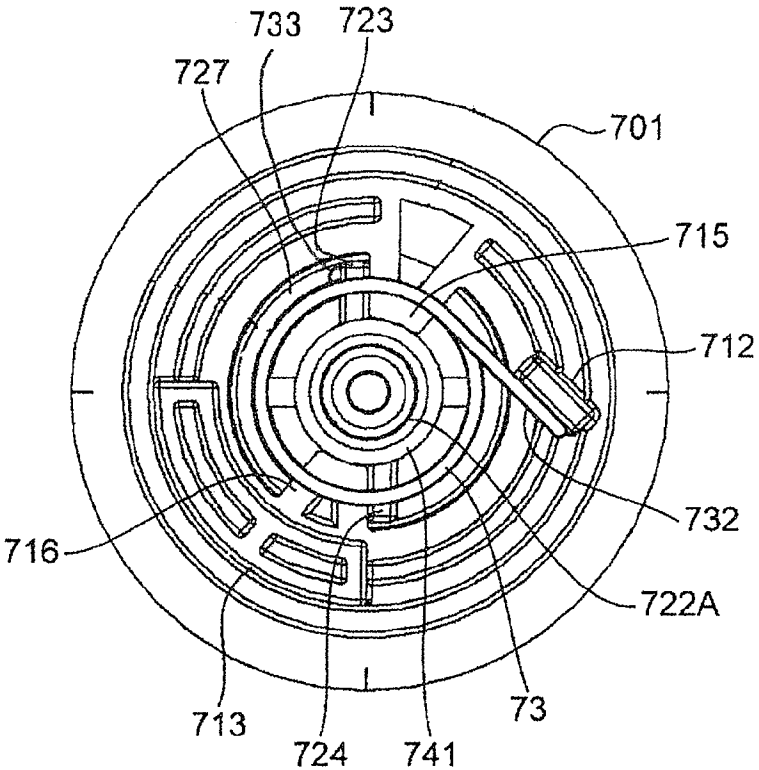
FIG. 11B is a front view of the main gear 70.
Figure 11A:
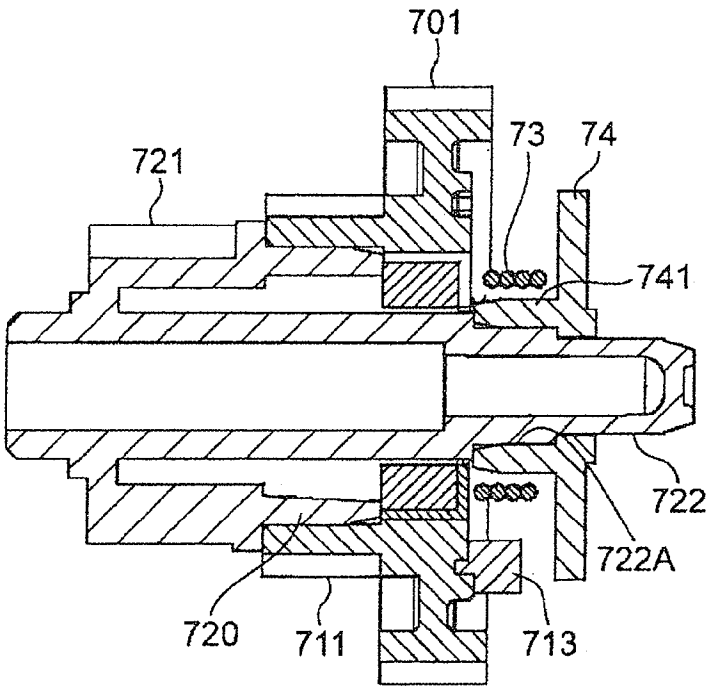
FIG. 11A is a cross-sectional side view of the main gear 70.

Such problems described above have been solved by studying a setup of the main gear 70. FIG. 9 is a perspective view of the main gear 70 according to an embodiment of the present disclosure. FIG. 10 is an exploded perspective view of the main gear 70. FIG. 11A is a cross-sectional side view and FIG. 11B is a front view of the main gear 70, respectively.

Referring now to FIG. 9 and FIG. 10, the main gear 70 includes a driving gear 71 (first transmission part), a transmission gear 72 (second transmission part) and a coil spring 73 (restriction member).

The driving gear 71 is a cylindrical gear. The driving gear 71 includes an input gear 701 (drive input gear) and a registration transmission gear 711 (first gear). The input gear 701 and the registration transmission gear 711 are gears formed around an outer circumferential surface of the driving gear 71 and are arranged adjacent with each other along an axial direction of the driving gear 71. The input gear 701 is connected to the above-described driving unit 500 to receive a rotational driving force. An outer diameter of the input gear 701 is set larger than an outer diameter of the registration transmission gear 711. A hollow insertion part 714 is arranged inside the input gear 701 and the registration transmission gear 711 along a radial direction thereof.

In addition, the driving gear 71 includes a first support part 715 and a second support part 716 (both are first protrusions) in the insertion part 714. The first support part 715 and the second support part 716 are a pair of protruding members arranged to face each other at an inner part corresponding to the input gear 701 in the insertion part 714. The first support part 715 and the second support part 716 protrude toward a rotation axis about which the driving gear 71 rotates. An insertion hole 715A axially extending is arranged inside the first support part 715.

Furthermore, the driving gear 71 includes a locking part 712 and a guide frame 713 at a side face of the driving gear 71 on a side of the input gear 701. The locking part 712 is a member like a plate that protrudes from the above-described side face in an axial direction of the driving gear 71. In addition, the guide frame 713 protrudes from the side face while facing the locking part 712. The guide frame 713 is a protruding member having an arc shape.

The transmission gear 72 includes a feed transmission gear 721 (second gear), a slide part 720, and a supporting rod 722 (insertion shaft).

As described above, the feed transmission gear 721 transmits a rotational driving force to the feed roller 21B via the shaft 216 and engages with the feed gear 220.

The slide part 720 is arranged axially adjacent to the feed transmission gear 721. The slide part 720 has a cylindrical shape. An outer diameter of the slide part 720 is set slightly smaller than an inner diameter of the registration transmission gear 711 of the driving gear 71.

The supporting rod 722 is a cylindrical-shaped member that protrudes axially from a hollow portion of the slide part 720. The supporting rod 722 is inserted in the insertion part 714 inside a cylinder of the driving gear 71. The outer diameter of the supporting rod 722 is set gradually smaller in three stages towards an end of the supporting rod 722. A supporting rod central part 722A is arranged axially at a center part of the supporting rod 722. In addition, a supporting rod end part 722B is arranged at an end portion (slide part 720 side) of the supporting rod 722.

A pair of a first protruding piece 723 and a second protruding piece 724 (both are the second protrusions) is arranged at an external circumferential surface of the supporting rod end part 722B. The second protruding piece 724 is arranged opposite to the first protruding piece 723 in a circumferential direction of the supporting rod end part 722B. The first protruding piece 723 and the second protruding piece 724 are arranged in an axial direction of the transmission gear 72, such that an external circumferential surface of the supporting rod end part 722B is bridged with an inner side of the slide part 720. It should be noted that the first protruding piece 723 and the second protruding piece 724 are arranged to face the first support part 715 and the second support part 716, respectively, in a circumferential direction of the driving gear 71 when the transmission gear 72 is assembled with the driving gear 71.

A first rib 725 and a second rib 726 are arranged between the first protruding piece 723 and the second protruding piece 724 in the circumferential direction of the transmission gear 72, inside the slide part 720. The first rib 725 and the second rib 726 are ribs arranged inside the slide part 720. It should be noted that the second rib 726 does not appear in FIG. 10.

The coil spring 73 includes a main spring part 731 which is a metal wire wound multiple turns. The coil spring 73, which has a predetermined elastic force, controls relative rotation between the driving gear 71 and the transmission gear 72. In detail, the coil spring 73 allows a predetermined amount of the relative rotation between the driving gear 71 and the transmission gear 72, and subsequently restricts this relative rotation. The coil spring 73 includes a first spring end 732 and a second spring end 733. The first spring end 732 is formed in a manner that one end of the wire is protruded tangentially from a periphery of the main spring part 731 and bent back. As the first spring end 732 is formed, an end of the bent back wire is axially bent at the periphery of the main spring part 731. The second spring end 733 is formed. Meanwhile, the other end of the wire is also axially bent at the periphery of the main spring part 731. The first spring end 732 of the coil spring 73 engages with the driving gear 71. In addition, the second spring end 733 of the coil spring 73 engages with the transmission gear 72.

In this manner, the driving gear 71, the transmission gear 72 and the coil spring 73 are assembled into the main gear 70. The supporting rod 722 of the transmission gear 72 is inserted into the insertion part 714 of the driving gear 71 on a side of the registration transmission gear 711. At this time, the slide part 720 of the transmission gear 72 is arranged to face an inner circumferential portion of the registration transmission gear 711 of the driving gear 71. In addition, the first protruding piece 723 and the second protruding piece 724 of the transmission gear 72 are arranged at an inner circumferential portion of the input gear 701 inside the insertion part 714. As described above, the pair of the first support part 715 and the second support part 716 is arranged at the inner circumferential portion of the input gear 701. Accordingly, the first protruding piece 723 and the second protruding piece 724 are inserted circumferentially between the first support part 715 and the second support part 716 (refer to FIG. 11B). In this manner, the transmission gear 72 is rotatable only within a predetermined range of angle inside the driving gear 71, when the transmission gear 72 is inserted in the driving gear 71. That is, the transmission gear 72 and the driving gear 71 are relatively rotatable according to a range in which the first protruding piece 723 and the second protruding piece 724 are circumferentially movable between the first support part 715 and the second support part 716.

Under the condition described above, the coil spring 73 is installed in the driving gear 71 and the transmission gear 72. At this time, the first spring end 732 of the coil spring 73 is engaged with the locking part 712 (FIG. 11B). Furthermore, the second spring end 733 of the coil spring 73 is inserted into the insertion part 714, such that the second spring end 733 is arranged circumferentially between the first protruding piece 723 and the second support part 716. The first spring end 732 of the coil spring 73 is fixed to the locking part 712 and the first protruding piece 723 is fixed to the first support part 715 of the driving gear 71, respectively. Meanwhile, the second spring end 733 is inserted into the insertion part 714 (FIG. 11B).

Furthermore, the driving gear 71 includes a cover 74 (FIG. 11A). The cover 74 prevents the coil spring 73 from falling from the driving gear 71. The cover 74 includes a cylinder part 741 having a cylindrical shape protruding from its brim part of a disk shape. As shown in FIG. 11A, since the cylinder part 741 of the cover 74 is inserted inside the coil spring 73 and outside the supporting rod central part 722A of the supporting rod 722, the coil spring 73 is prevented from falling.

Operation of Main Gear 70

Figure 12A:
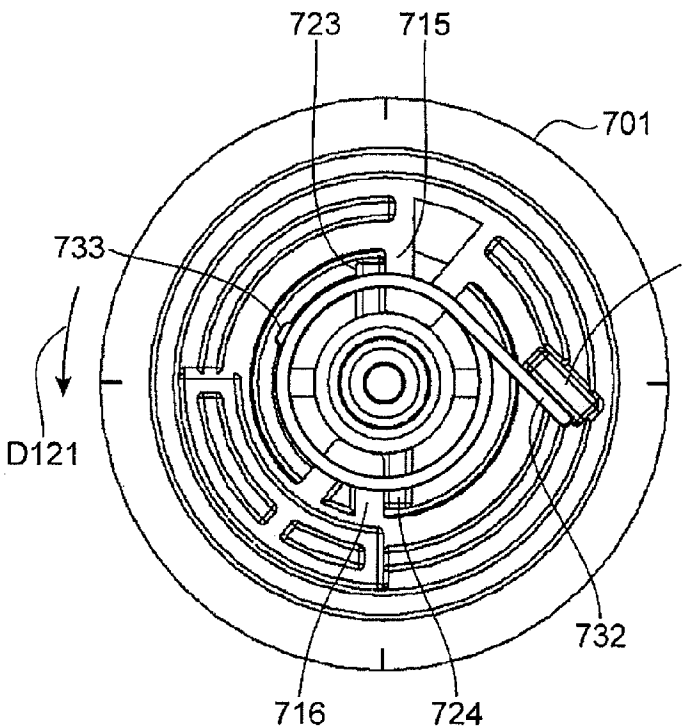
FIG. 12A is a front view illustrating rotation of the main gear 70.
Figure 12B:
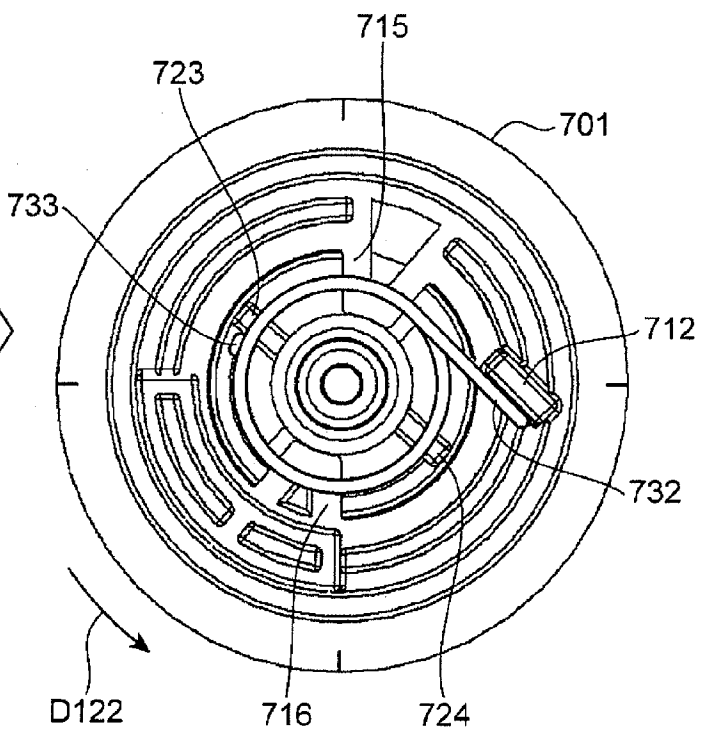
FIG. 12B is a front view illustrating rotation of the main gear 70.

Next, the operation of the main gear 70 according to the present embodiment will be described with reference to FIG. 12 and FIG. 13. FIG. 12A and FIG. 12B are each a front view for illustrating the behavior of the main gear 70 following the operation of the sheet sender 21A. FIG. 12A and FIG. 12B differ from each other in a rotation angle of the feed transmission gear 721 (first protruding piece 723) with respect to the input gear 701. The driving unit 500 rotationally drives the main gear 70 as a sheet P of recording medium is fed out. At this time, the driving unit 500 transmits a rotational driving force to the input gear 701 in the main gear 70. Accordingly, as shown in FIG. 12A, the input gear 701 rotates in a direction of arrow D121 first. As the input gear 701 rotates, the first support part 715 and the second support part 716 of the input gear 701 press the first protruding piece 723 and the second protruding piece 724 of the transmission gear 72, respectively. Accordingly, the transmission gear 72 rotates in the direction of the arrow D121 in FIG. 12A. When the rotational driving force is transmitted from the input gear 701 to the feed transmission gear 721 as described above, the feed gear 220 is rotationally driven and the eccentric cam 60 starts moving and the feed roller 21B starts rotating.

As described in the above problem, when the lift plate 21P moves upward as the eccentric cam 60 rotates, it may be that the biasing force of the biasing spring 21S is transmitted to the eccentric cam 60 via the arm protrusion 211. Accordingly, the rotational driving force PW2 exerted by the arm protrusion 211 is applied to the eccentric cam 60 in addition to the rotational driving force PW1 transmitted from the main gear 70. It may be that the rotational driving force PW2 creates excessive rotation of the eccentric cam 60 and causes the feed gear 220 via the shaft 216 to experience a rotational variation. Even if such a case occurs, the main gear 70 according to the present embodiment prevents the excessive rotation occurring at the feed gear 220 from being transmitted to the registration gear 231.

In other words, when the feed gear 220 structurally integral with the eccentric cam 60 excessively rotates, it is possible that excessive rotation also occurs at the feed transmission gear 721 connected to the feed gear 220. In this case, the feed transmission gear 721 has a higher rotation speed momentarily than the input gear 701 which rotates by receiving the rotational driving force from the driving unit 500. As a result, as shown in FIG. 12B, the first protruding piece 723 and the second protruding piece 724 of the transmission gear 72 rotate in a direction of arrow D122, preceding the first support part 715 and the second support part 716 of the input gear 701.

As described above, the second spring end 733 of the coil spring 73 is arranged circumferentially between the first protruding piece 723 and the second support part 716. Accordingly, the first protruding piece 723 of the transmission gear 72, whose rotation precedes the input gear 701, pushes the second spring end 733 to move outward in course of time. Since the first spring end 732 of the coil spring 73 is fixed to the driving gear 71, the coil spring 73 starts elastic deformation as the first protruding piece 723 presses the second spring end 733.

While the coil spring 73 is experiencing elastic deformation, the transmission gear 72 rotates (runs idle) relative to the driving gear 71. Accordingly, the driving force transmitted from the lift plate 21P to the eccentric cam 60 is absorbed by the coil spring 73 and is not transmitted to the driving gear 71. Since the coil spring 73 absorbs the driving force transmitted to the eccentric cam 60, it is possible to prevent the influence exerted on the rotation of the registration roller 23 via the registration transmission gear 711 of the driving gear 71.

Relative rotation of the transmission gear 72 with respect to the driving gear 71 continues until the driving force transmitted from the biasing spring 21S to the transmission gear 72 through the eccentric cam 60 and the elastic force of the coil spring 73 are balanced with each other. That is, when the first protruding piece 723 moves beyond the elastic energy that can be accumulated by the coil spring 73, the driving gear 71 and the transmission gear 72 resume rotating in unison with each other. It should be noted that if the relative rotation of the transmission gear 72 with respect to the driving gear 71 continues excessively, the eccentric cam 60 will not be braked, causing the above-described collision noise. For this reason, it may be desirable that the spring constant of the coil spring 73 is set such that the driving force transmitted to the transmission gear 72 from the eccentric cam 60 and the elastic force of the coil spring 73 are balanced with each other before the leading edge of a topmost sheet P among sheets P placed on the lift plate 21P comes in contact with the circumferential surface of the feed roller 21B.

Figure 13:
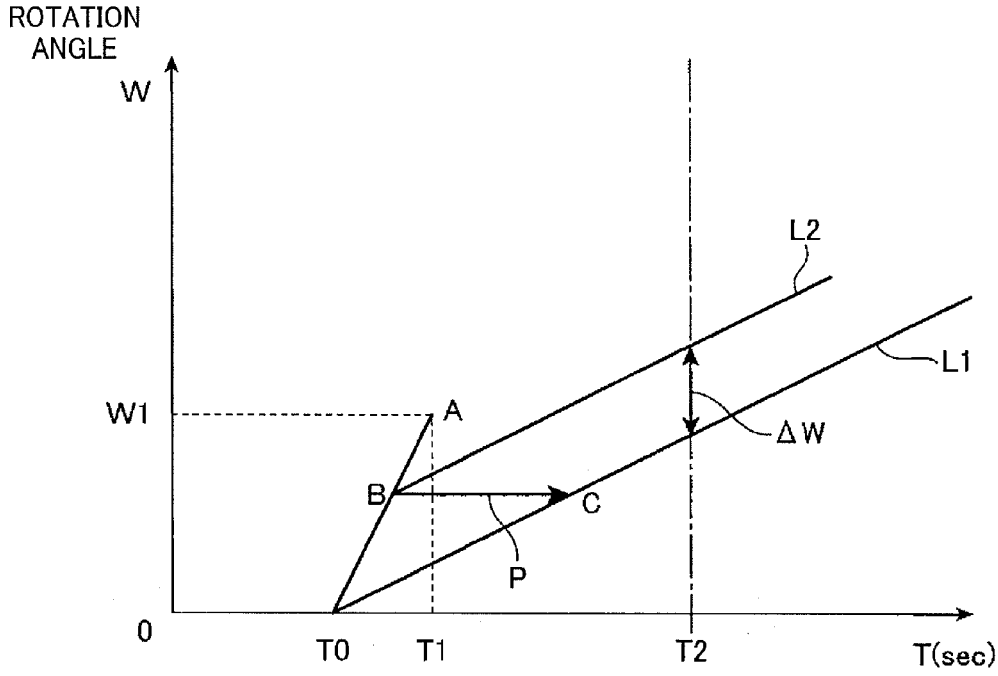
FIG. 13 shows a graph for illustrating a rotation angle of a feed roller 21B.

FIG. 13 shows a graph for illustrating the rotation of the feed roller 21B for a case where the main gear 70 according to the present embodiment is adopted. A horizontal axis indicates time T (sec) and a vertical axis indicates an accumulated rotation angle of the feed roller 21B with respect to the elapsed time T. A straight line L1 indicates a rotation angle of the feed roller 21B when sheets P of a maximum number are placed on the lift plate 21P. In this case, a topmost sheet P among the sheets P placed on the lift plate 21P momentarily comes in contact with the circumferential surface of the feed roller 21B. Accordingly, the rotational driving force is transmitted to the feed roller 21B at time T0. As shown by the straight line L1, the rotation angle of the feed roller 21B increases linearly with respect to the elapsed time T.

Meanwhile, when sheets of paper P of a small number are placed on the lift plate 21P, the transmission gear 72 which constitutes the main gear 70 rotates relative to the driving gear 71 as described above. In addition, a strong rotational driving force is exerted on the feed roller 21B configured to be integral with the transmission gear 72 by the biasing force applied by the biasing spring 21S in an initial time period. That is, as shown in FIG. 13, the feed roller 21B rotates rapidly from time T0 to a point B. When the driving force transmitted to the transmission gear 72 from the eccentric cam 60 and the elastic force of the coil spring 73 are balanced with each other at the point B, the feed roller 21B rotates linearly as shown by a straight line L2. It should be noted that if rapid rotation of the feed roller 21B continues to a point A beyond the point B, an impulsive noise may occur between the sheets P placed on the lift plate 21P and the circumferential surface of the feed roller 21B.

When the sheets P of the maximum number are placed on the lift plate 21P, the feed roller 21B rotates as shown by the straight line L1. On the other hand, when the sheets P of the small number are placed on the lift plate 21P, the feed roller 21B rotates as shown by the straight line L2. Due to the difference of such conditions, a difference ΔW of the rotation angle arises at time T2. That is, an amount of feeding a sheet P will change depending on the number of sheets P placed on the lift plate 21P.

However, the coil spring 73 is arranged at the main gear 70 in the present embodiment as described above. That is, while the coil spring 73 absorbs the driving force transmitted to the transmission gear 72 from the eccentric cam 60, the rotational driving force exerted by the driving unit 500 is not transmitted to the transmission gear 72 from the driving gear 71. That is, the feed roller 21B stops rotating from the point B to a point C as shown in FIG. 13. Subsequently, the rotation of the feed roller 21B increases linearly with respect to the elapsed time T from the point C on, as shown by the straight line L1. In this manner, the coil spring 73 enables a time lag associated with the transmission of the rotational driving force between the driving gear 71 and the transmission gear 72. Accordingly, even when there is a difference in the number of sheets P placed on the lift plate 21P, it is possible to suppress a difference in transition of the rotation speed of the feed roller 21B.

According to the present embodiment, even if the number of sheets P placed on the lift plate 21P changes, it is possible to suppress the difference in transition of the rotation speed of the feed roller 21B. Accordingly, it is possible to prevent an adverse influence on the conveyance of a sheet P performed by the registration roller 23. That is, sheets P that experience vertical movement applied by the lift plate 21P biased upward by the biasing spring 21S are reliably fed sheet by sheet to the feed roller 21B by the driving force transmitted from the main gear 70.

At this time, in order to suppress a noise generated by a collision between the sheets P placed on the lift plate 21P and the circumferential surface of the feed roller 21B due to sudden upward movement of the lift plate 21P, the contact part 601 of the eccentric cam 60 moves along the locking slope 213 (first slope), the 21st slope 214 (second slope) and the 22nd slope 215 (third slope) of the arm protrusion 211. Accordingly, it is possible to prevent the eccentric cam 60 from separating suddenly from the arm protrusion 211 and to allow the lift plate 21P to move upward gradually and smoothly.

Meanwhile, it may be that the biasing force of the biasing spring 21S is brought to the eccentric cam 60 through the arm protrusion 211, following such movement of the eccentric cam 60. Accordingly, the rotational driving force applied through pressing by the arm protrusion 211 is added to the eccentric cam 60 in addition to the rotational driving force transmitted from the main gear 70. Under such a situation, the transmission gear 72 constituting the main gear 70 rotates relative to the driving gear 71. Furthermore, since the coil spring 73 is arranged between the driving gear 71 and the transmission gear 72, excessive rotation of the transmission gear 72 caused by the eccentric cam 60 is effectively absorbed by the coil spring 73. Since a variation does not occur in the rotation of the driving gear 71, there will be no adverse effect on the rotation of the registration roller 23. As a result, when a preceding sheet P is held between the transfer nip TP and the registration roller 23, it is possible to prevent the sheet P from experiencing disordered transfer of a toner image at the transfer nip TP.

In addition, the cylindrical driving gear 71 according to the above-described embodiment includes at its circumference the registration transmission gear 711 which transmits a rotational driving force to the registration roller 23. In addition, the transmission gear 72 includes the feed transmission gear 721 which transmits a rotational driving force to the shaft 216 (feed roller 21B) and the supporting rod 722 which is arranged at a side of the feed transmission gear 721 and inserted into the insertion part 714 of the driving gear 71. The driving gear 71 and the transmission gear 72 are configured to be rotatable relative to each other, when the supporting rod 722 of the transmission gear 72 is inserted into the insertion part 714 of the driving gear 71. In this manner, the inside of the driving gear 71 is efficiently utilized, so that it is possible to downsize the main gear 70.

In addition, the driving gear 71 according to the above-described embodiment includes in the insertion part 714 the first support part 715 and the second support part 716 which both protrude toward the axis of the driving gear 71. In addition, the transmission gear 72 includes the first protruding piece 723 and the second protruding piece 724. They protrude from the supporting rod 722 and are circumferentially arranged opposite to the first support part 715 and the second support part 716, respectively, with respect to the driving gear 71. Accordingly, the driving gear 71 and the transmission gear 72 are configured to be rotatable relative to each other within a predetermined range inside an internal space of the driving gear 71.

In addition, the driving gear 71 according to the above-described embodiment includes the input gear 701 which is arranged adjacent to the registration transmission gear 711 and receives a rotational driving force transmitted from the driving unit 500. According to this configuration, the input gear 701 receives the rotational driving force from the driving unit 500 and the registration transmission gear 711 transmits the rotational driving force to the registration roller 23.

In addition, in the above-described embodiment, the feed gear 220 which engages with the feed transmission gear 721 is arranged at the shaft 216. Accordingly, a driving force is transmitted reliably to the feed roller 21B and the eccentric cam 60 from the feed transmission gear 721 through the feed gear 220.

In addition, the coil spring 73 is arranged as a restriction member in the above-described embodiment. One end of the coil spring 73 is engaged with the driving gear 71 and the other end is engaged with the transmission gear 72. With the coil spring 73, the transmission gear 72 is allowed to rotate a predetermined amount relative to the driving gear 71 and subsequently restricted from rotating. In addition, the elastic force of the coil spring 73 prevents the eccentric cam 60 from being suddenly braked, causing the feed roller 21B to smoothly start rotating.

In addition, in the above-described embodiment, the clutch 501 is arranged, which switches between coupling and decoupling of the transmission of the rotational driving force from the main gear 70 to the feed gear 220. Accordingly, it is possible to stop the feed roller 21B in advance of the registration roller 23 in order to provide an interval between sheets P conveyed continuously.

At this time, the clutch 501 transmits a rotational driving force to the shaft 216, and disconnects the rotational driving force after the feed roller 21B rotates one revolution. Accordingly, the eccentric cam 60 comes again in contact with the arm protrusion 211, so that it is possible to push the lift plate 21P downward in response to one revolution of rotation performed by the feed roller 21B.

Furthermore, in the above-described embodiment, the circumferential length of the feed roller 21B is set longer than the distance between the feed roller 21B and the registration roller 23 in the main conveying path 22F, when viewed in a cross-section perpendicular to the shaft 216. For this reason, when the feed roller 21B rotates one revolution, the leading edge of a sheet P comes in contact with the registration roller 23. Accordingly, even when the lift plate 21P moves downward and the contact pressure applied by the feed roller 21B to the sheet P decreases, the sheet P is conveyed stably by the registration roller 23.

Although the sheet sender 21A having the main gear 70 according to the embodiment of the present disclosure, and the feed unit 20 and the image forming apparatus 1 which each have the sheet sender 21A have been described above, the present disclosure is not limited to these and may alternatively employ the following modified embodiments, for example.

(1) Although the embodiment has been described above in which the transmission gear 72 is restricted from rotating relative to the driving gear 71 by the coil spring 73 arranged between the driving gear 71 and the transmission gear 72, present disclosure is not limited to this. It may alternatively be that another elastic member having so-called damper performance is arranged between the driving gear 71 and the transmission gear 72.

(2) In addition, although the embodiment has been described above in which the driving gear 71 transmits a rotational driving force to the registration roller 23 and the transmission gear 72 transmits a rotational driving force to the feed roller 21B via the shaft 216, with respect to the driving gear 71 and the transmission gear 72, each of which constitutes the main gear 70, the present disclosure is not limited to this. It may alternatively be that the cylindrical driving gear 71 transmits a rotational driving force to the feed roller 21B and the transmission gear 72 having the supporting rod 722 which is inserted inside the driving gear 71 transmits a rotational driving force to the registration roller 23.

The invention claimed is:

1. A sheet conveying device comprising:

a lift plate onto which a sheet of recording medium is placed;

a sheet conveying path configured to convey the sheet of recording medium placed on the lift plate in a predetermined sheet conveying direction;

a slope part attached to the lift plate and configured to slope downward in the sheet conveying direction;

a biasing member configured to apply a force to the lift plate to cause a leading edge of the sheet of recording medium in the sheet conveying direction to move upward;

a feed roller, which is arranged to be contactable with the leading edge of the sheet of recording medium, configured to be rotationally driven to feed the sheet of recording medium in the sheet conveying direction;

a conveyance roller, which is arranged downstream of the feed roller in the sheet conveying direction, configured to be rotationally driven to convey the sheet of recording medium fed out by the feed roller;

a rotation shaft, which extends in a sheet width direction perpendicular to the sheet conveying direction, configured to rotatably support the feed roller;

a cam member, which is arranged at the rotation shaft to be rotatable in unison with the rotation shaft, configured to be contactable with the slope part;

a driving unit configured to generate a rotational driving force to cause the feed roller and the conveyance roller to rotate; and a gear train configured to be connected to the driving unit such that the gear train is rotationally driven; wherein the gear train comprises:

a first transmission part configured to transmit the rotational driving force to one of the conveyance roller and the rotation shaft;

a second transmission part, which is arranged coaxial with the first transmission part, configured to be relatively rotatable with respect to the first transmission part and to transmit the rotational driving force to the other one of the conveyance roller and the rotation shaft; and a restriction member configured to allow a predetermined amount of relative rotation of the second transmission part with respect to the first transmission part and to subsequently restrict the relative rotation.

2. The sheet conveying device according to claim 1, wherein the first transmission part has a cylindrical shape and comprises at an external circumference thereof a first gear configured to transmit the rotational driving force to the conveyance roller or the rotation shaft, the second transmission part comprises a second gear and an insertion shaft, the second gear configured to transmit the rotational driving force to the conveyance roller or the rotation shaft and the insertion shaft, which is arranged at a side of the second gear, configured to be inserted inside a cylinder of the first gear.

3. The sheet conveying device according to claim 2, wherein the first transmission part comprises inside the cylinder a first protrusion protruding toward a rotation axis of the first transmission part, and the second transmission part comprises a second protrusion protruding from the insertion shaft to face the first protrusion in a circumferential direction of the first transmission part.

4. The sheet conveying device according to claim 2, wherein the first transmission part comprises a drive input gear configured to receive the rotational driving force transmitted from the driving unit.

5. The sheet conveying device according to claim 2, wherein the first transmission part transmits the rotational driving force to the conveyance roller, and the second transmission part transmits the rotational driving force to the rotation shaft, and the sheet conveying device further comprises a third gear which is arranged at the rotation shaft and configured to engage with the second gear.

6. The sheet conveying device according to claim 2, wherein the restriction member comprises a coil spring in which one end is engaged with the first transmission part and the other end is engaged with the second transmission part.

7. The sheet conveying device according to claim 1, wherein the cam member comprises a pair of cams arranged at axially both ends of the rotation shaft, the lift plate comprises a pair of arm protrusions protruding opposite to the cam member in a direction in which the sheet of recording medium is placed, and the slope part is arranged on each of the pair of arm protrusions.

8. The sheet conveying device according to claim 7, further comprising:

a pair of arms arranged to stand upright on both ends of the lift plate in the sheet width direction and to include the pair of arm protrusions; and a shaft support arranged at a rear end side of each of the pair of arms in the sheet conveying direction and configured to pivotally support the lift plate.

9. The sheet conveying device according to claim 1, wherein the slope part comprises a first slope, a second slope connected to the first slope, and a third slope connected to the second slope, the lift plate is movable among a first position, a second position, and a third position, where the first position is defined as a position where the lift plate is most spaced apart from the feed roller when the cam member comes in contact with the first slope to cause the biasing member to be elastically deformed, the second position is defined as a position where the lift plate is closer to the feed roller than the first position when the cam member is rotationally driven to come in contact with the second slope, and the third position is defined as a position where the lift plate is closer to the feed roller than the second position and causes the sheet of recording medium placed on the lift plate to come in contact with the feed roller when the cam member is rotationally driven to depart from the second slope.

10. The sheet conveying device according to claim 1, further comprising a clutch configured to perform switching between coupling and decoupling of the rotational driving force from the gear train to the rotation shaft.

11. The sheet conveying device according to claim 10, wherein the clutch couples the rotational driving force to the rotation shaft from the gear train, and decouples the rotational driving force after one revolution of the feed roller.

12. The sheet conveying device according to claim 11, wherein a circumferential length of the feed roller is longer than a distance between the feed roller and the conveyance roller in the sheet conveying path when viewed in a cross-section perpendicular to the rotation shaft.

13. The sheet conveying device according to claim 1, wherein the conveyance roller comprises a registration roller configured to regulate a position of the sheet of recording medium in the sheet width direction.

14. A feed device comprising:

a sheet conveying device; and a sheet container which accommodates a sheet of recording medium; wherein the sheet conveying device includes:

a lift plate onto which the sheet of recording medium is placed;

a sheet conveying path for conveying the sheet of recording medium on the lift plate into a predetermined sheet conveying direction;

a slope part which is attached to the lift plate and inclined downward toward the sheet conveying direction;

a biasing member which applies force to the lift plate so as to move a leading edge of the sheet of recording medium upward in the sheet conveying direction;

a feed roller which is arranged to be able to contact the leading edge of the sheet of recording medium, is rotary-driven, and sends out the sheet of recording medium into the sheet conveying direction;

a conveyance roller which is arranged downstream of the feed roller in the sheet conveying direction and conveys the sheet of recording medium sent out by the feed roller;

a rotation shaft which extends in a sheet width direction that is perpendicular to the sheet conveying direction and supports the feed roller rotatably;

a cam member which is arranged on the rotation shaft to be able to rotate together with the rotation shaft and can contact the slope part;

a driving unit which generates rotational driving force which rotates the feed roller and the conveyance roller; and a gear train which is connected to the driving unit to be rotary-driven; wherein the gear train includes:

a first transmission part which transmits the rotational driving force to either one of the conveyance roller and the rotation shaft;

a second transmission part which is arranged coaxial with the first transmission part, is relatively rotatable with respect to the first transmission part, and transmits the rotational driving force to the other one of the conveyance roller and the rotation shaft;

a restriction member which regulates relative rotation of the second transmission part with respect to the first transmission part after allowing a predetermined amount of the relative rotation; and the lift plate is arranged in the sheet container.

15. An image forming apparatus comprising:

a sheet conveying device;

a sheet container which accommodates a sheet of recording medium; and an image forming unit which forms an image onto the sheet of recording medium; wherein the sheet conveying device includes:

a lift plate onto which the sheet of recording medium is placed;

a sheet conveying path for conveying the sheet of recording medium on the lift plate into a predetermined sheet conveying direction;

a slope part which is attached to the lift plate and inclined downward toward the sheet conveying direction;

a biasing member which applies force to the lift plate so as to move a leading edge of the sheet of recording medium upward in the sheet conveying direction;

a feed roller which is arranged to be able to contact the leading edge of the sheet of recording medium, is rotary-driven, and sends out the sheet of recording medium into the sheet conveying direction;

a conveyance roller which is arranged downstream of the feed roller in the sheet conveying direction and conveys the sheet of recording medium sent out by the feed roller;

a rotation shaft which extends in a sheet width direction that is perpendicular to the sheet conveying direction and supports the feed roller rotatably;

a cam member which is arranged on the rotation shaft to be able to rotate together with the rotation shaft and can contact the slope part;

a driving unit which generates rotational driving force which rotates the feed roller and the conveyance roller; and a gear train which is connected to the driving unit to be rotary-driven; wherein the gear train includes:

a first transmission part which transmits the rotational driving force to either one of the conveyance roller and the rotation shaft;

a second transmission part which is arranged coaxial with the first transmission part, is relatively rotatable with respect to the first transmission part, and transmits the rotational driving force to the other one of the conveyance roller and the rotation shaft; and a restriction member which regulates relative rotation of the second transmission part with respect to the first transmission part after allowing a predetermined amount of the relative rotation, and the lift plate is arranged in the sheet container.

* * * * *